US006193550B1

(12) United States Patent
Yamashita et al.

(10) Patent No.: US 6,193,550 B1
(45) Date of Patent: Feb. 27, 2001

(54) COUPLING CONNECTOR

(75) Inventors: Tetsuya Yamashita; Toshiaki Okabe, both of Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/290,161

(22) Filed: Apr. 13, 1999

(30) Foreign Application Priority Data

Apr. 27, 1998 (JP) ..... 10-117184

(51) Int. Cl.[7] ..... H01R 13/40
(52) U.S. Cl. ..... 439/594; 439/717
(58) Field of Search ..... 495/594, 595, 495/701, 712, 717

(56) References Cited

U.S. PATENT DOCUMENTS 5,288,251 * 2/1994 Sumida ..... 439/701
5,643,015 * 7/1997 Wakata ..... 439/701
5,788,347 * 8/1998 Rabinovitz ..... 439/701
5,893,778 * 4/1999 Mansutti ..... 439/701
5,904,598 * 5/1999 Yamanashi ..... 439/701

FOREIGN PATENT DOCUMENTS 62-15774 1/1987 (JP) .

* cited by examiner

*Primary Examiner*—Hien Vu
(74) *Attorney, Agent, or Firm*—Finnegan, Henderson, Farabow, Garrett & Dunner, L.L.P.

(57) ABSTRACT

A coupling connector includes: a connector housing of a first connector having an engagement piece formed by projecting an outer wall thereof; and a connector housing of a second connector having an engagement groove formed on an outer wall thereof. In the construction, the engagement piece is engaged with the engagement groove. The engagement piece and engagement groove are formed so as to be engaged with each other in an engagement direction intersecting perpendicularly to a coupling direction where the first and second connectors are coupled to each other. The connector housing of the first connector is slid to the coupling direction with respect to the connector housing of the second connector so that the engagement piece is engaged with the engagement groove so that the first connector and second connector are coupled to each other.

4 Claims, 5 Drawing Sheets

COUPLING CONNECTOR

BACKGROUND OF THE INVENTION

1. Field of the Invention

The present invention relates to a coupling connector which is constituted such that a plurality of connectors are coupled to each other so as to make one set.

2. Description of the Related Art

A coupling connector which are constituted such that connectors are coupled to each other to improve a handling property of plural connectors. FIGS. 1 and 2 show a conventional coupling connector 1. A plurality of terminal accommodation chambers 6 and 7 are formed respectively in connector housings 4 and 5 of two connectors 2 and 3 to be coupled to each other. Electric wires 10 and 11 are led from wire harnesses 8 and 9 into the terminal accommodation chambers 6 and 7 of the respective connectors so as to be connected with terminals (not shown) in the terminal accommodation chambers 6 and 7.

These connectors 2 and 3 are coupled to each other by sliding the connector housings 4 and 5 relative to a direction of an arrow D. In order to obtain this coupling, an engagement groove 12 is formed on an outer wall on one side of the connector housing 4 of the connector 2, and an engagement projection 13 having a T shape which is engaged with the engagement groove 12 is formed on an outer wall of the connector housing 5 of the connector 3 which faces the engagement groove 12. The engagement groove 12 and engagement projection 13 are extended along an engagement direction of the connector housings 4 and 5. When the engagement projection 13 is engaged with the engagement groove 12 and they are slid together, the connectors 2 and 3 can be coupled to each other as shown in FIG. 2. There is disclosed in Japanese Patent Application Laid-Open No.62-15774 a coupling connector using such a coupling structure.

However, in the conventional coupling connector 1, there is a gap 14 between the engagement groove 12 and engagement projection 13 due to thermal shrinkage which occurs when the connector housing 4 and 5 are injection molded and other causes as shown in FIG. 3. This gap causes looseness in directions of arrows 16 and 17, thereby occurring relative displacement of the connector housings 4 and 5 as shown by a broken line. The occurrence of such looseness causes pitch displacement of the connector housings 4 and 5. As a result, when engaged with a mating connector, the coupling connector 1 interferes with the mating connector, and they become unstable, thereby being difficult to engage with each other. Furthermore, the terminals in the terminal accommodation chambers 6 and 7 cannot come in contact with terminals of the mating connector satisfactorily.

SUMMARY OF THE INVENTION

The present invention has been achieved with such points in view. It therefore is an object of the invention to provide a coupling connector having a structure so that it can be engaged with a mating connector smoothly without occurring an unstable state between connector housings to be coupled to each other.

To achieve the object, a first aspect of the invention provides a coupling connector comprising: a connector housing of a first connector having an engagement piece formed by projecting an outer wall thereof; and a connector housing of a second connector having an engagement groove formed on an outer wall thereof, the engagement piece being engaged with the engagement groove, wherein the engagement piece and engagement groove are formed so as to be engaged with each other in an engagement direction intersecting perpendicularly to a coupling direction where the first and second connectors are coupled to each other; and wherein the connector housing of the first connector is slid to the coupling direction with respect to the connector housing of the second connector so that the engagement piece is engaged with the engagement groove so that the first connector and second connector are coupled to each other.

According to this aspect of the invention, the connector housing is slid so that the engagement piece of the one connector housing is engaged with the engagement groove of the other connector housing, and thus both the connectors can be coupled to each other. Since the engagement piece and engagement groove of the present invention are arranged so that the engagement direction intersects perpendicularly to the coupling direction where the connectors are coupled to each other by sliding, after the connectors are coupled to each other, the connector housings of both the connectors are fixed to fixed positions respectively, and thus an unstable state and pitch displacement does not occur. As a result, the coupling connector can be engaged with a mating connector smoothly, and the terminals (not shown) can be brought into contact with each other satisfactorily.

According to a second aspect of the invention, the engagement piece is sufficiently elastic such that it can be deflected along the engagement direction; and the engagement piece is engaged with the engagement groove in a state where the engagement piece is deflected.

According to this aspect of the invention, since the engagement piece is engaged with the engagement groove while being deflected elastically along the engagement direction, the engagement piece closely contacts the engagement groove along the engagement direction. As a result, both connectors are coupled to each other firmly in the engagement direction, and thus the coupling without pitch displacement can be achieved.

According to a third aspect of the invention, the engagement piece is formed with a projected bar which comes into contact with the engagement groove.

According to this aspect of the invention, the projected bar comes in contact with the engagement groove precedently, and this contact increases a deflection amount of the engagement piece. As a result, the engagement piece closely contacts the engagement groove, and thus a coupling force between the connectors are increased. Moreover, the deflection amount of the engagement piece becomes large, and only the projected bars come into contact with the engagement groove so that a contact portion of the engagement piece with the engagement groove is reduced. As a result, friction, which is generated when the connector housing is slid is reduced, and the connectors can be slid smoothly.

BRIEF DESCRIPTION OF THE ACCOMPANYING DRAWINGS

The above and further objects and novel features of the present invention will more fully appear from the following detailed description when the same is read in conjunction with the accompanying drawings, in which.

DETAILED DESCRIPTION OF THE PREFERRED EMBODIMENTS

Figure 1:
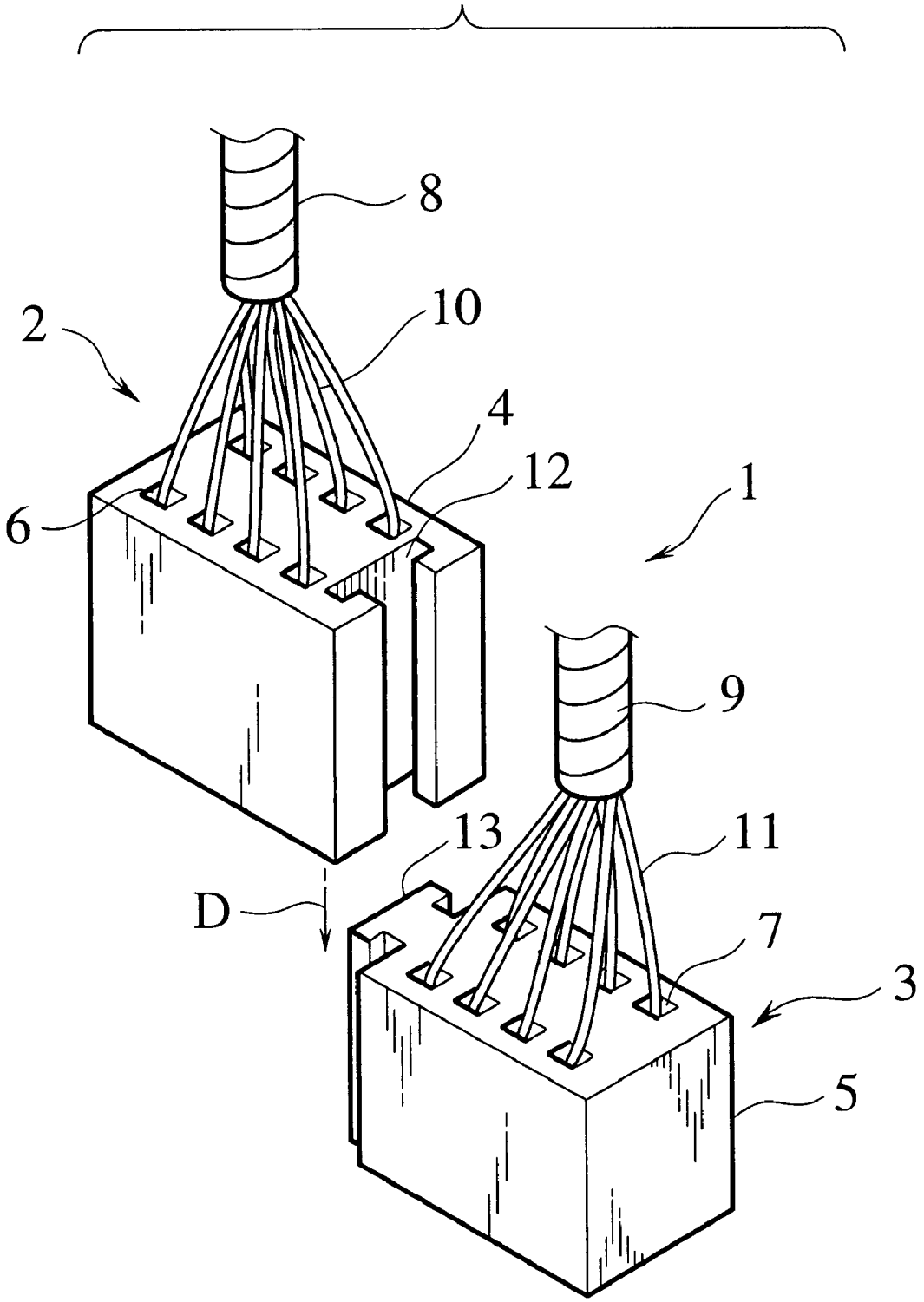
FIG. 1 PRIOR ART
FIG. 1 is a perspective view of a conventional coupling connector before coupling.
Figure 2:
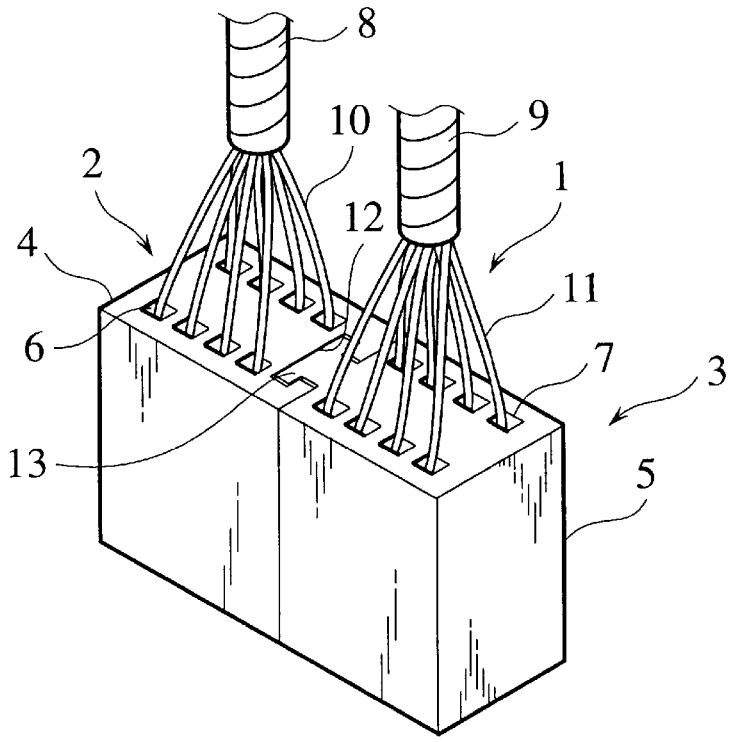
FIG.2 PRIOR ART
FIG. 2 is a perspective view of the conventional coupling connector in a coupled state.
Figure 3:
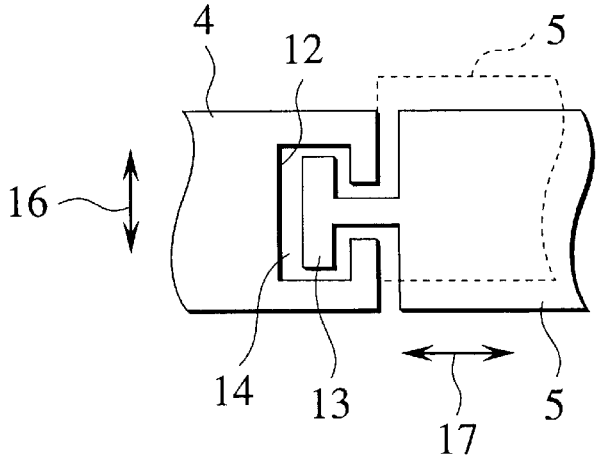
FIG.3 PRIOR ART
FIG. 3 is a plan view illustrating problems of the conventional coupling connector.
Figure 4:
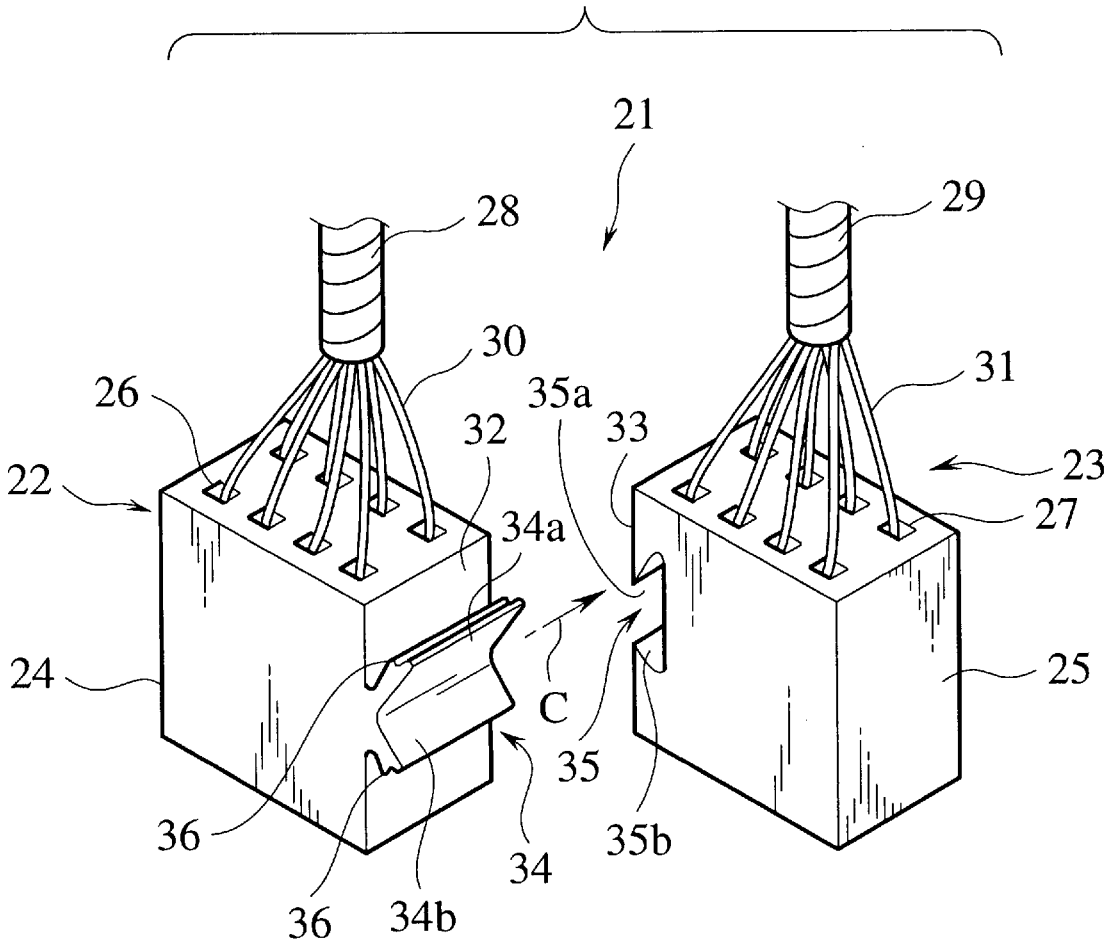
FIG. 4 is a perspective view of a connector according to an embodiment of the present invention before coupling.
Figure 5:
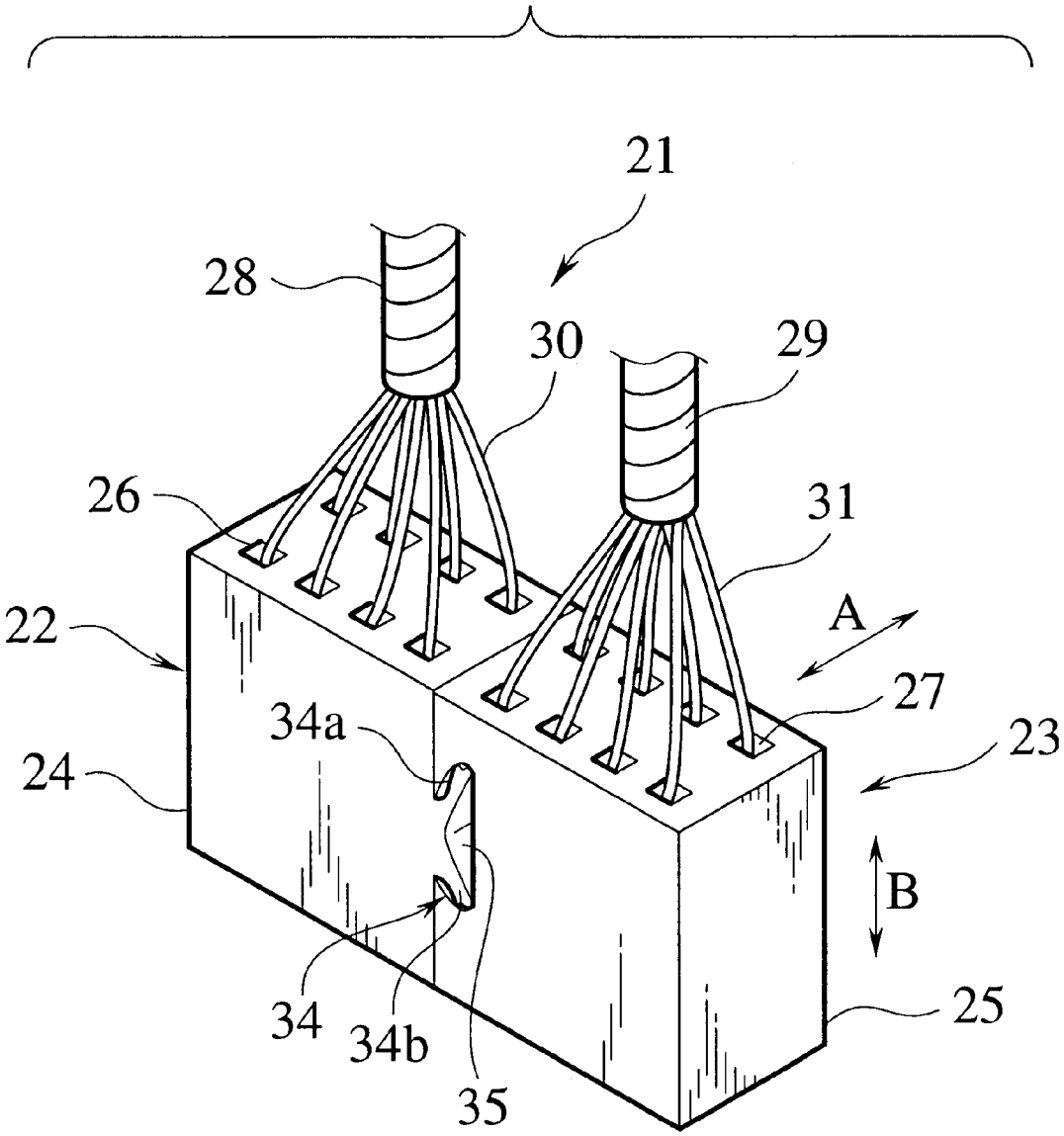
FIG. 5 is a perspective view of the connector according to the embodiment in a coupled state.

There will be detailed below the preferred embodiments of the present invention with reference to FIGS. 4 through 7. FIG. 4 is a perspective view of a coupling connector according to an embodiment of the present invention before coupling, and FIG. 5 is a perspective view of the coupling connector in the coupled state. A coupling connector 21 according to the embodiment is configured such that a first connector 22 and second connector 23 are slid in a direction of an arrow C in FIG. 4 and are coupled to each other.

The first and second connectors 22 and 23 respectively have connector housings 24 and 25, and a plurality of terminal accommodation chambers 26 and 27 are formed respectively in the connector housings 24 and 25. Moreover, the terminal accommodation chambers 26 and 27 of the connector housings 24 and 25 accommodate terminals (not shown). Further, the connectors 22 and 23 are connected respectively with wire harnesses 28 and 29. Namely, the wire harnesses 28 and 29 each have electric wires 30 and 31, and terminals of the electric wires 30 and 31 are connected with the terminals in the terminal accommodation chambers 26 and 27 so that the wire harnesses 28 and 29 are connected respectively with the connectors 22 and 23.

In an outer wall 32 of the connector housing 24 of the first connector 22, an engagement piece 34 is projected there from on a side facing the second connector 23. On the other hand, in an outer wall 32 of the connector housing 25 of the second connector 23, an engagement groove 35 is recessed on an outer wall 33 on a side facing the first connector 22.

The engagement piece 34 is projected from the outer wall 32 of the connector housing 24 in a direction intersecting perpendicularly to a sliding direction C of the connectors, and has a pair of lips 34*a* and 34*b* projecting in a slanting manner with respect to the outer wall 32. The pair of lips 34*a* and 34*b* are capable of being deflected, and thus the engagement piece 34 has elasticity such that its whole can be deflected.

This deflection is along a direction (engagement direction B, mentioned later) which intersects perpendicularly to the sliding direction C (coupling direction A of the connectors 22 and 23, mentioned later) because the pair of lips 34*a* and 34*b* are extended from the outer wall 32 in the direction which intersects perpendicularly to the sliding direction C when the connectors 22 and 23 are coupled to each other as mentioned above. Here, the pair of lips 34*a* and 34*b* have a length that is identical to a width of the connector housing 24.

Figure 6:
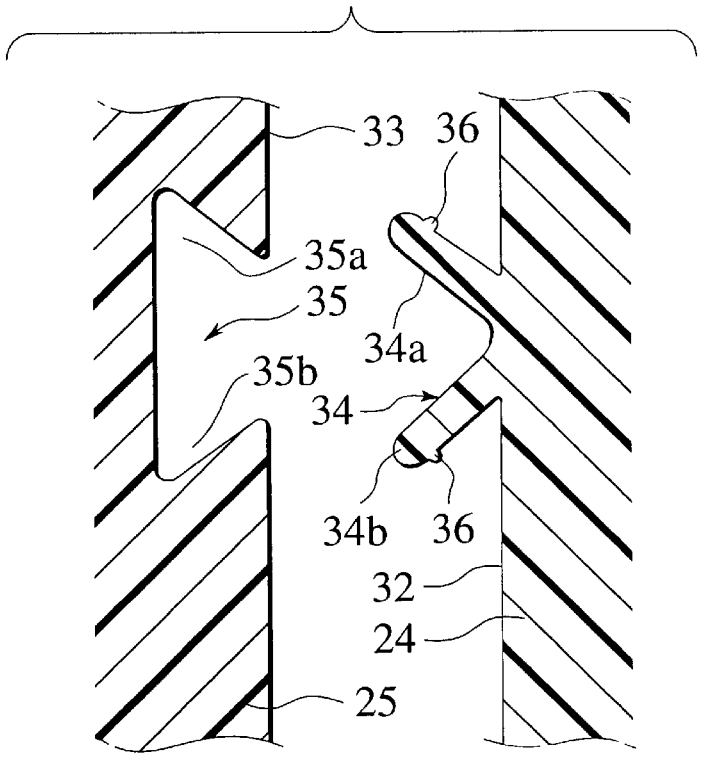
FIG. 6 is an enlarged section of an engagement piece and engagement groove.

Further, as shown in FIG. 6, projected bars 36 are formed on the engagement piece 34. These projected bars 36 are projected from a surface on each lip 34*a* and 34*b* on the outer wall 32 side so as to have a length identical to that of the lips 34*a* and 34*b*. When the engagement piece 34 is engaged with the engagement groove 35, the projected bars 36 come into contact with the engagement groove 35 precedently.

As shown in FIG. 6, the engagement groove 35 is formed in a dovetail groove shape having a pair of engagement portions 35*a* and 35*b* with which the pair of lips 34*a* and 34*b* of the engagement piece 34 are engaged. The engagement groove 35 has a length that is identical to a width of the connector housing 25.

There will be detailed below an operation for coupling the connectors 22 and 23 according to the embodiment. First, as shown in FIG. 4, the connectors 22 and 23 are arranged so that the engagement piece 34 faces the engagement groove 35, and the engagement piece 34 is then engaged with the engagement groove 35. Next, The first connector 22 is slid relative to the direction of the arrow C with respect to the second connector 23. This sliding operation allows the engagement piece 34 to be elastically deflected and be engaged with the engagement groove 35, and the connector housings 24 and 25 are coupled to each other. As a result, as shown in FIG. 5, the coupling connector 21 where the first and second connectors 22 and 23 are coupled to each other can be obtained.

In the present embodiment, the pair of lips 34*a* and 34*b* of the engagement piece 34 are extended to the direction which intersects perpendicularly to the sliding direction C of the connectors, and are engaged with the engagement groove 35 in a direction intersecting perpendicularly to the coupling direction A of the connectors 22 and 23 (which is identical to the sliding direction C). In other words, the engagement piece 34 and engagement groove 35 are engaged with each other along the engagement direction B intersecting perpendicularly to the coupling direction A of the connectors 22 and 23.

Since such engagement of the connectors 22 and 23 in the direction intersecting perpendicularly to the coupling direction attains firm coupling between the connectors 22 and 23, after the connectors 22 and 23 are coupled to each other, the connector housings 24 and 25 do not become unstable and pitch displacement does not occur. As a result, the coupling connector 21 can be engaged with a mating connector smoothly and without interference therebetween, and the terminals in the connectors 22 and 23 can come in contact with the terminals in the mating connector satisfactorily.

Figure 7:
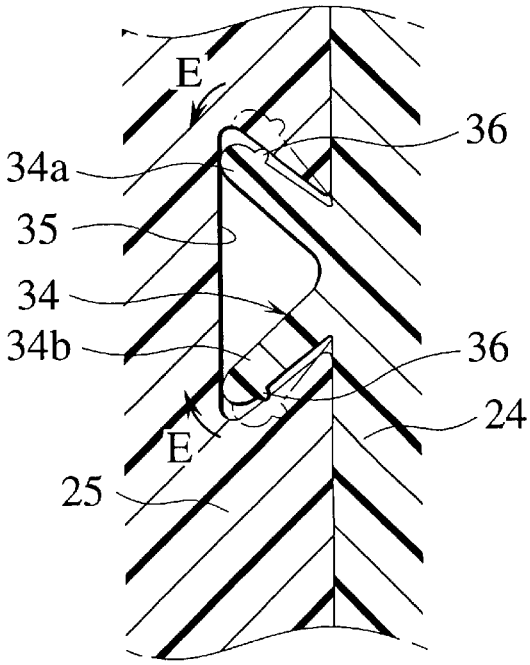
FIG. 7 is a section showing a state that the engagement piece is engaged with the engagement groove.

In addition, when engaged with the engagement groove 35, the engagement piece 34 of the present embodiment is elastically deflected along the direction B of the engagement with the engagement groove 35 as shown by an arrow E of FIG. 7. This deflection achieves close contact of the engagement piece 34 with the engagement groove 35 along the engagement direction B. As a result, the connectors 22 and 23 are coupled to each other more firmly in the engagement direction B, and they can be coupled to each other without pitch displacement.

Further, when the engagement piece 34 is engaged with the engagement groove 35, the projected bars 36 provided on the engagement piece 34 come in contact with the engagement groove precedently. This contact increases a deflection amount of the engagement piece 34. As a result, the engagement piece 34 contacts the engagement groove 35 closely, and thus a coupling force between the connectors 22 and 23 is increased. Moreover, the deflection amount of the engagement piece 34 becomes larger as mentioned above, and besides, only the projected bars 36 come into contact with the engagement groove 35, and thus a contact area between the engagement piece 34 and engagement groove 35 is reduced. As a result, friction, which is generated when the connector housings 24 and 25 are slid, is reduced, and they can be slid smoothly.

While preferred embodiments of the present invention have been shown using specific terms, such description is for illustrative purposes, and it is to be understood that changes and variations may be made without departing from the spirit or scope of the following claims.

What is claimed is:

1. A coupling connector, comprising:

a first connector having an engagement piece extending from an outer wall thereof, the engagement piece having a pair of dovetail shaped lips with an elongated bar arranged on each lip, at least a portion of the engagement piece being generally flexible such that at least a portion of the engagement piece can be deflected; and a second connector having an engagement groove recessed into an outer wall thereof, whereby the first connector can be attached to the second connector by moving at least a portion of the engagement piece into at least a portion of the engagement groove.

2. A connector according to claim 1, wherein the bar runs the entire length of the lip on which it is formed.

3. A coupling connector, comprising:

a first connector having an engagement piece extending from an outer wall thereof, at least a portion of the engagement piece being generally flexible such that at least a portion of the engagement piece can be deflected; and a second connector having an engagement groove recessed into an outer wall thereof, whereby the first connector can be attached to the second connector by moving at least a portion of the engagement piece into at least a portion of the engagement groove, wherein the engagement piece has a dimension that is larger than a dimension of the engagement groove when in an undeflected state, the engagement piece can be deflected such that the dimension of the engagement piece that is larger than the dimension of the engagement groove when the engagement piece is in the undeflected state is smaller than the dimension of the engagement groove when the engagement piece is in a deflected state, and the engagement piece comprises a pair of dovetail shaped lips.

4. A coupling connector, comprising:

a first connector having an engagement piece extending from an outer wall thereof, the engagement piece having a bar formed thereon; and a second connector having an engagement recess recessed into an outer wall thereof, whereby the first connector can be attached to the second connector by moving at least a portion of the engagement piece into at least a portion of the engagement groove such that the bar of the engagement piece precedently contacts the engagement recess, wherein at least a portion of the engagement piece is generally flexible such that at least a portion of the engagement piece can be deflected and the engagement piece can be deflected such that a dimension of the engagement piece that is larger than a dimension of the engagement recess when the engagement piece is in an undeflected state is smaller than the dimension of the engagement recess when the engagement piece is in a deflected state.

* * * * *